US006126512A

United States Patent [19]

Chao et al.

[11] Patent Number: 6,126,512

[45] Date of Patent: Oct. 3, 2000

[54] ROBUST BELT TRACKING AND CONTROL SYSTEM FOR HOSTILE ENVIRONMENT

[75] Inventors: Mike Chao; Tim H. Huynh, both of San Jose; Chi Guo, Cupertino; Huey M. Tzeng, San Jose, all of Calif.

[73] Assignee: Aplex Inc., Moraga, Calif.

[21] Appl. No.: 09/113,485

[22] Filed: Jul. 10, 1998

[51] Int. Cl.[7] ..... F16H 7/18

[52] U.S. Cl. ..... 451/9; 451/297; 198/810.03

[58] Field of Search ..... 451/297, 311, 451/516, 9; 198/810.03, 807

[56] References Cited

U.S. PATENT DOCUMENTS

| | | | |
|---|---|---|---|
| 3,913,729 | 10/1975 | Andrews | 198/202 |
| 3,956,632 | 5/1976 | Hall et al. | 250/223 R |
| 4,369,878 | 1/1983 | Millevoi | 198/807 |
| 4,959,040 | 9/1990 | Gardner et al. | 474/103 |
| 5,096,044 | 3/1992 | Biebel | 198/502.4 |
| 5,101,980 | 4/1992 | Arvidson | 209/546 |
| 5,157,444 | 10/1992 | Mori et al. | 355/282 |
| 5,184,424 | 2/1993 | Miller | 51/135 |
| 5,197,999 | 3/1993 | Thomas | 51/298 |
| 5,230,184 | 7/1993 | Bukham | 51/283 R |
| 5,257,478 | 11/1993 | Hyde et al. | 51/131.3 |
| 5,358,098 | 10/1994 | Sundstrom et al. | 198/806 |
| 5,503,265 | 4/1996 | Hussar et al. | 198/807 |
| 5,575,707 | 11/1996 | Talieh et al. | 451/173 |

OTHER PUBLICATIONS

"Enhancing Web Processes With Tension Transducer Systems," *Sensors,* Aug. 1997, pp. 40–44.

*Primary Examiner*—Lowell A. Larson
*Assistant Examiner*—William Hong
*Attorney, Agent, or Firm*—Skjerven, Morrill, MacPherson, Franklin and Friel

[57] ABSTRACT

An automated tracking and control system measures the lateral displacement of a moving belt, using non-contact sensing. The displacement signal is provided to an algorithm that adjusts the tilts of the belt pulleys and steers the belt laterally. Non-contact sensors include inductive proximity sensors, which respond to the metal belt but are immune to airborne slurry and other non-metallic debris in a hostile environment typical of wafer polishing. Other non-contact sensors include shielded optical sensors. Dual sensor configurations cancel response to non-lateral displacements. Instrumentation, such as tension sensors, cylinder pressure sensors, load transducers, and limit switches, provides input to the algorithm. Independent tension signals for each belt edge verify proper functioning of, e.g., pad conditioners. User-specified belt displacements, e.g., dither, sawtooth oscillation, step, ramp, and sweep, combine with selective texturing and other variable pad properties to provide a desired polishing rate profile.

13 Claims, 5 Drawing Sheets

ROBUST BELT TRACKING AND CONTROL SYSTEM FOR HOSTILE ENVIRONMENT

FIELD OF THE INVENTION

The present invention relates to a process requiring the tracking and control of a belt in any hostile environment, including those used in chemical-mechanical polishing (CMP). In particular, the present invention relates to a robust belt tracking and control system for a hostile CMP environment.

BACKGROUND

In sub-micron scale integrated circuits, CMP techniques are used to create the planarity required in multi-level interconnect structures. Specifically, to create a planar surface for depositing an interconnect layer, e.g. aluminum, tungsten, or copper, an interlayer dielectric (e.g., silicon dioxide) is planarized by a polishing process. This polishing process uses a polishing pad, usually polyurethane, under pressure in frictional contact with the wafer surface. The polishing pad carries an alkaline or acidic slurry with fine abrasive.

CMP in semiconductor processing removes the highest points from the surface of a wafer to polish the surface, as described for example in Leach, U.S. Pat. No. 5,607,341, issued Mar. 4, 1997. CMP operations are performed on unprocessed and partially processed wafers. A typical unprocessed wafer is crystalline silicon or another semiconductor material that is formed into a nearly circular flat wafer. A typical wafer, when ready for polishing, has a top layer of a dielectric material such as glass, silicon dioxide, or of a metal conformally overlying one or more patterned layers. These underlying patterned layers create local protrusions on the order of about 1 $\mu$m in height on the surface of the wafer. Polishing smoothes the local features, so that ideally the surface of the wafer is flat or planarized over an area the size of a die (a potential semiconductor chip) formed on the wafer. Currently, polishing is sought that locally planarizes the wafer to a tolerance of about 0.3 $\mu$m over the area of a die about 10 mm by 10 mm in size.

To maintain uniformity over the polished surface of the interlayer dielectric and to provide wafer-to-wafer reproducibility (global uniformity) of the polishing process, the polishing surface, typically a polyurethane pad, is required to be conditioned during use or between uses. Conditioning is necessary to maintain a uniform, textured or profiled surface on the polishing pad.

Polishing rate and uniformity depend in a complex fashion on a number of process variables at the wafer-pad interface, significantly contact pressure, relative velocity between the polishing pad and wafer surface, elastomeric properties including hardness (durometer) of the polishing pad, physical and chemical properties of the slurry, and rate of chemical reaction.

Traditionally, CMP is performed using a planetary CMP apparatus. FIG. 1 is a schematic plan view of a planetary CMP apparatus 100. As shown in FIG. 1, CMP apparatus 100 includes a polishing table or platen 103, rotating in a direction indicated by reference numeral 105. Onto platen 103 is mounted a polishing pad 104. A silicon wafer (not shown) is mounted onto a polishing head 101 and is pressed against the surface of polishing pad 104. Polishing head 101 rotates the silicon wafer in a direction 109, generally in the same direction 105 of rotating platen 103. Additionally, an oscillating arm 106 reciprocates polishing head 101 transversely along an arc indicated by reference numerals 108*a* and 108*b*. Correspondingly, a conditioning pad (not shown) is mounted onto a smaller platen 102 and is pressed against polishing pad 104. Platen 102 rotates in a direction indicated by reference numeral 110 and is reciprocated throughout the CMP process by an oscillating arm 111 along an arc indicated by reference numerals 107*a* and 107*b*. Slurry is sprayed or applied by other conventional methods onto the surface of polishing pad 104 throughout the CMP process by a slurry dispenser 113.

Process control is difficult to achieve in a traditional planetary CMP configuration of FIG. 1. Nonuniform removal rates are produced at the wafer-pad interface due to the locally variable and complex motion of the polishing pad relative to the wafer surface.

FIGS. 2*a* and 2*b* are side and front views, respectively, of a linear CMP apparatus 200. An example of such a linear polishing apparatus is disclosed in Anderson et al., "Modular Wafer Polishing Apparatus and Method," U.S. application Ser. No. 08/964,930, filed Nov. 5, 1997, the disclosure of which is incorporated herein by reference in its entirety and which is copending herewith and assigned to Aplex Inc., also the Assignee of the present application.

As shown in FIGS. 2*a* and 2*b*, linear CMP apparatus 200 includes a continuous polishing belt 201 configured to polish one or more vertically supported semiconductor wafers, such as a wafer 207. Wafer 207 is held vertically by a polishing head 205, which presses wafer 207 against a polishing pad 208 attached to vertically mounted polishing belt 201. Polishing belt 201 is kept in continuous motion at a selected polishing speed within a range of approximately 1–10 ft per second or 0.3–3 meters per second by rotating pulleys 202 and 203. A center support 206 provides an opposing pressure to hold wafer 207 at a preselected pressure within a range of approximately 1–10 PSI, or 6–70 kPa, against polishing pad 208. Polishing head 205 rotates in a predetermined direction indicated by reference numeral 216 and is reciprocated laterally by an oscillating mechanism (not shown) across the surface of polishing pad 208 along a path indicated by reference numerals 211*a* and 211*b*. Thus, the combined motions, of polishing belt 201, polishing head 205, and an oscillating mechanism cooperatively provide linear polishing of the surface of wafer 207.

While FIGS. 2*a*–2*b* show only one side of the polishing belt assembly being used for wafer polishing, polishing heads 205 can be positioned on both sides of the polishing belt assembly of CMP apparatus 200 relative to a plane of mirror symmetry containing the axes of both pulleys 202, 203, thereby effectively doubling the total wafer throughput. A slurry dispenser 213 is mounted proximate to polishing belt 201, to apply slurry to polishing pad 208. A linear pad conditioning assembly 204 is mounted proximate to polishing belt 201, to provide conditioning for polishing pad 208 attached to the surface of polishing belt 201. Linear pad conditioning assembly 204 includes a linear motion mechanism that causes a conditioning surface to travel in the directions indicated by reference numeral 209 transversely relative to the direction of belt travel, indicated by reference numeral 215. The combined motions of the linear motion mechanism and polishing belt 201 provide linear conditioning of polishing pad 208.

Similar to center support 206, a conditioner back support 217 typically provides an opposing pressure to hold conditioning assembly 204 at a preselected pressure within a range of e.g., 1–10 PSI, or 6–70 kPa, against polishing pad 208. When polishing heads 205 are provided on both sides of polishing belt assembly 200, a linear pad conditioning assembly 204 can be provided on each side of polishing belt 201.

In linear CMP processing, automatic control over the lateral position of the moving polishing belt is required. Without lateral position control, the belt can eventually slip laterally and slide off either end of a pulley.

Some attempts to control lateral belt position have required slow and unreliable human intervention. Tension sensing by means of strain gauges has been applied to related processes involving linear web transport, e.g. printing and paper or foil making (see for example Breen, "Enhancing Web Processes with Tension Transducer Systems," Sensors, August 1997, pp. 40–44). Conventional instrumentation has proved difficult because of the hostile environment, including rapidly moving and vibrating machinery, water spray, and airborne slurry and other particulates.

Accordingly, it would be desirable to provide an automated, fast-response, robust tracking and control system for lateral belt positioning in a hostile linear CMP environment. It would further be desirable to provide an automated, fast-response, versatile belt control and steering system for a hostile linear CMP environment, that selectively applies polishing pad regions having differing properties to processing selective areas of the wafer surface in order to achieve desired removal rates.

SUMMARY

The present invention is applicable to the tracking and control of a polishing belt which is driven by pulleys in a continuous loop linear polishing operation. Particularly, the present invention is applicable to a robust belt tracking and control system for use in a hostile environment. In general, the present invention is applicable to a wide range of operations requiring the tracking and control of a continuous loop belt in any hostile environment.

In some embodiments, the automated tracking and control system measures the lateral displacement of an edge of the moving belt, using at least one non-contact position sensor. The edge displacement signal is coupled into a processing unit, which adjusts a tension adjustment mechanism that controls the relative tilts of the two pulley axes and thereby controls the relative tensions along the two edges of the belt. The change in the relative tensions along the two edges of the belt steers the belt laterally.

In some embodiments, the non-contact sensor is an inductive proximity sensor, which measures the proximity of electrically conductive objects within a sensing range, but ignores nonconductive materials, including airborne water droplets and particulates such as slurry. This type of sensor therefore responds to the metal belt (usually stainless steel) but is immune to airborne slurry and other debris in a hostile environment. In some embodiments, the non-contact sensor is a shielded optical sensor.

An inductive proximity sensor responds not only to lateral movement of the edge of the belt, but also to longitudinal movement parallel to the thickness of the belt and mutually perpendicular to the direction of driven belt motion and to the lateral direction. In some embodiments, dual sensor configurations are devised in which sensors are mounted facing one another from opposite sides of the belt. Summing and averaging the signals from such dual sensors results in cancellation of longitudinal displacement response, resulting in a purely lateral displacement response. In other embodiments, dual sensor configurations are devised in which sensors are mounted on the same side of the belt. Subtracting the signal of one such paired sensor from the signal of the other paired sensor results in cancellation of longitudinal displacement response, resulting in a purely lateral displacement response.

In some embodiments, the tension adjustment mechanism includes two or more pressure cylinders that apply selectively variable pressure as determined by the control algorithm to the two ends of the pulley axes. In some embodiments, auxiliary instrumentation, including one or more of tension sensors, cylinder pressure sensors, load transducers, limit switches, and home switches, provides input signals to the processing unit for use by the control algorithm. For example, the belt tension adjacent to each edge and the applied pressure at each end of the pulley axes are measured separately, and these measurements are applied by the control algorithm to determine if the pressures and/or tensions are out-of-normal limits. In some embodiments, independent tension signals adjacent each edge of the belt allow verification of engagement and proper functioning of, e.g., a pad conditioning mechanism. In some embodiments, the sensor and instrumentation signals are collected by a data acquisition system, prior to transfer to the processing unit.

In some embodiments, user-specified instructions are entered into the control algorithm to obtain a desired lateral belt displacement, including, for example, dither, sawtooth oscillation, step, ramp, and sweep. In particular, in some embodiments this is combined with selective polishing pad texturing and/or variable pad property to obtain a desired removal rate profile in a polishing operation. In some embodiments, a polishing pad has a surface partitioned into regions having one or more properties variable from region to region. Properties include, for example, surface hardness, overall pad thickness, primary pad thickness, secondary pad thickness, porosity, filler type, underlying belt thickness, belt contour, and chemical reactivity. In some embodiments, the regions are configured as strips running substantially parallel to the direction of driven belt motion. In some embodiments, the strips are configured, so that the joint between adjacent strips is oriented at an oblique angle relative to the direction of driven belt motion. In some embodiments, the surface of a region or of an entire pad is textured, for example, in a repetitive diamond-shaped pattern.

The present invention is better understood upon consideration of the detailed description below, in conjunction with the accompanying drawings.

BRIEF DESCRIPTION OF THE DRAWINGS

The present invention may be better understood, and its numerous objects, features, and advantages made apparent to those skilled in the art by referencing the accompanying drawings. For simplicity and ease of understanding, common numbering of elements within the illustrations is employed where an element is the same in different drawings.

DETAILED DESCRIPTION OF THE EMBODIMENTS

The following is a detailed description of illustrative embodiments of the present invention. As these embodiments of the present invention are described with reference to the aforementioned drawings, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings are not to be considered in a limiting sense as it is understood that the present invention is in no way limited to the embodiments illustrated.

In accordance with the present invention, non-contact sensors, for example, inductive proximity sensors, are used for lateral position sensing of a linear CMP polishing belt. This type of sensor is immune to the presence of slurry, water spray, and all electrically nonconducting materials.

Figure 3:
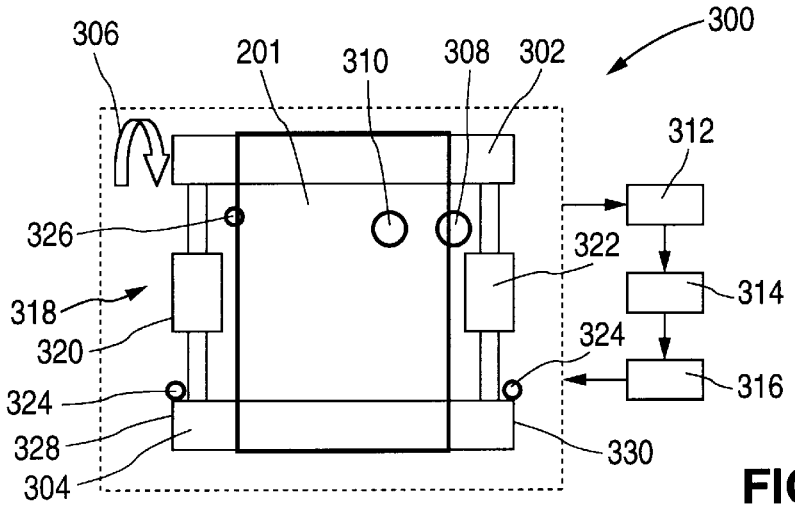
FIG. 3 is a schematic view of a linear CMP belt tracking system, in accordance with an embodiment of the present invention.

FIG. 3 is a schematic view of a linear CMP belt tracking system 300, in accordance with an embodiment of the present invention. Polishing belt 201 is supported and driven by an upper pulley 302 and a lower pulley 304 in a direction indicated by reference numeral 306. A belt position sensor 308 is positioned adjacent one edge of polishing belt 201. In addition, an optional auxiliary belt position sensor 310 can also be positioned adjacent polishing belt 201.

Position sensor 308 (along with optional auxiliary position sensor 310 where applicable) is connected to a data acquisition system 312, which in turn is connected to a processing unit 314. Processing unit 314 is configured to provide output signals or values to a control mechanism 316 to control a tension adjustment system 318. Tension adjustment system 318 includes pressure cylinders 320 and 322 interconnected with left and right ends respectively of both upper pulley 302 and lower pulley 304. In an embodiment, CMP belt tracking system 300 is also instrumented with conventional load transducers 328 and 330 to measure belt tension independently at each edge of polishing belt 201 and/or to measure cylinder pressure independently at each pressure cylinder 320, 322. The output signals or values of such belt tension and/or cylinder pressure instrumentation are also provided to data acquisition system 312. Belt tracking system 300 can include one or more limit switches 324 and/or a home position switch 326, whose output signals or values are likewise provided to data acquisition system 312.

Position sensors 308, 310 are inductive proximity sensors, which respond to the presence of electrically conducting metal targets within a narrowly defined sensing range. Thus, inductive proximity sensors respond to the presence of a stainless steel polishing belt. The response increases with proximity of the sensor to the target and with coverage of the sensor area by the target. Inductive proximity sensors are well known in the art. An example of a commercially available inductive proximity sensor is Model IA8-30GM-13, from Pepperl+Fuchs®Inc., 1600 Enterprise Parkway, Twinsburg, Ohio 44087-2245.

Figure 4A:
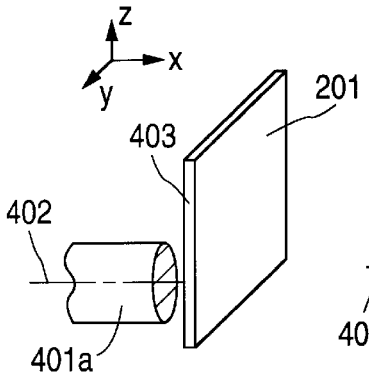
FIGS. 4*a*–4*c* are isometric views of a polishing belt, showing the relative positions and orientations of inductive proximity sensors, in accordance with an embodiment of the present invention.
Figure 4B:
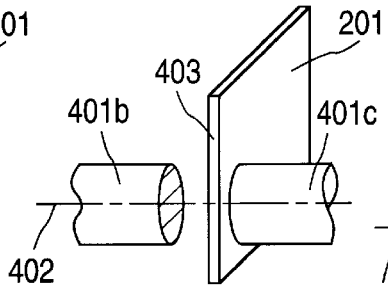
Figure 4C:
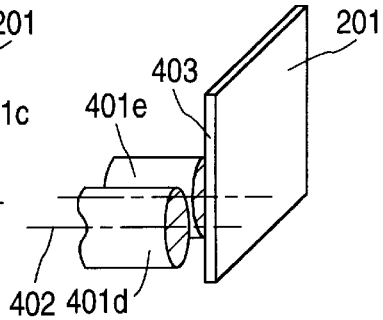

FIGS. 4*a*–4*c* are isometric views of polishing belt 201, showing the relative positions and orientations of inductive proximity sensors 401*a*–401*e*. As shown in FIG. 4*a*, a single proximity sensor 401*a* is positioned such the sensing axis 402 of proximity sensor 401*a* is aligned substantially in the longitudinal x-direction perpendicular to the plane of polishing belt 201, which moves in the z-direction (see coordinate arrows in FIG. 4*a*). The sensing axis 402 of proximity sensor 401*a* approximately intersects the y-axis equilibrium position of an edge 403 of moving polishing belt 201. Thus, at equilibrium, moving belt 201 covers approximately half of the sensing area of proximity sensor 401*a*. Under these conditions, proximity sensor 401*a* delivers an equilibrium signal to data acquisition system 312 (see FIG. 3).

If the lateral position of polishing belt 201 along the y-direction changes, then edge 403 is displaced in the lateral y-direction relative to sensing axis 402, and polishing belt 201 covers an area greater or smaller than half of the sensing area of proximity sensor 401*a*. Under such conditions, proximity sensor 401*a* delivers a signal that is greater or smaller than the equilibrium signal. This provides a feedback signal to data acquisition system 312 that drives a control loop to correct the lateral y-direction polishing belt displacement.

A single inductive proximity sensor, as shown in FIG. 4*a*, is frequently adequate to track the lateral y-position of polishing belt 201. However, in general the inductive proximity sensor is sensitive to both longitudinal x-direction and lateral y-direction displacement of a target within its sensing range. Therefore, to make the system more robust, in some embodiments a second inductive proximity sensor can be employed to compensate for any longitudinal x-direction displacement of polishing belt 201.

As shown in FIG. 4*b*, two inductive proximity sensors 401*b* and 401*c* are arranged in a face-to-face configuration on opposite sides of polishing belt 201. Sensors 401*b* and 401*c* share a common sensing axis 402, which approximately intersects the y-axis equilibrium position of polishing belt edge 403. In some embodiments, sensor 401*b* is offset from sensor 401*c* in the z-direction to avoid mutual inductive effects. The effect of longitudinal belt displacement is opposite on the two sensors, whereas the effect of lateral belt displacement is the same. Therefore, when the signals of sensors 401*b* and 401*c* are summed or averaged, then the effect of longitudinal displacement on the system is effectively canceled. The dual sensor position tracking system is thus responsive only to lateral displacements of polishing belt 201.

In another embodiment, as shown in FIG. 4*c*, two inductive proximity sensors 401*d* and 401*e* are arranged side-by-side on a single side of polishing belt 201. A primary sensor 401*d* is positioned and oriented similarly to sensor 401*a* of FIG. 4*a*. An auxiliary sensor 401*e* is positioned next to and aligned parallel with primary sensor 401*d*, such that polishing belt 201 entirely fills its sensing field. Thus auxiliary sensor 401*e* is insensitive to lateral belt displacement and responds only to longitudinal x-direction displacement of polishing belt 201. Primary sensor 401*d*, on the other hand, responds to both lateral and longitudinal belt displacement. Subtraction of the auxiliary signal from the primary signal therefore results in a signal measuring purely lateral belt displacement. As described below in greater detail, an algorithm has been developed incorporating the use of the signal of auxiliary sensor 401*e* to correct the effect of longitudinal displacement of polishing belt 201 on the edge sensing signal of primary sensor 401*d*. The configuration of FIG. 4*c* is particularly advantageous, where there is limited space available to mount an auxiliary sensor between the two oppositely moving sections of a polishing belt.

Figure 4D:
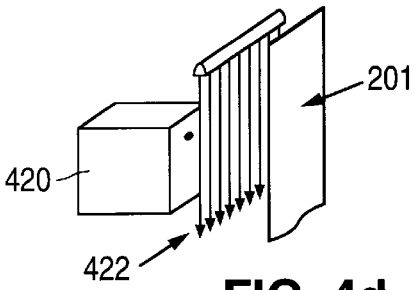
FIGS. 4*d*–4*f* are isometric views of various shielding configurations of an optical sensor, in accordance with an embodiment of the present invention.
Figure 4E:
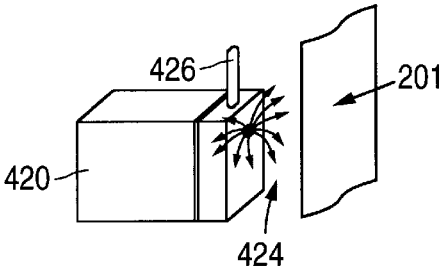
Figure 4F:
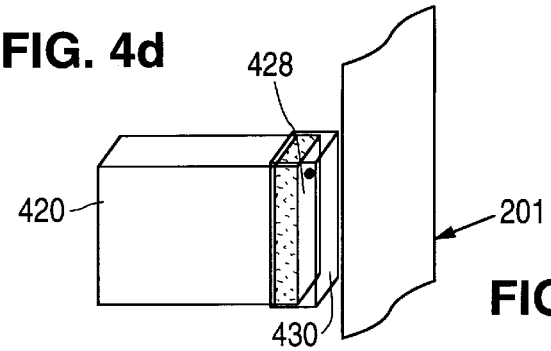

In a hostile environment, inductive proximity sensors have advantages over optical sensors. Airborne slurry and other particulates obscure the field of view of an optical sensor, whereas they are ignored by an inductive proximity sensor. To overcome this disadvantage, an optical sensor requires shielding by a transparent medium, for example, by immersion in water. FIGS. 4*d*–4*f* are isometric views of various shielding configurations of an optical sensor 420. In some embodiments, shielding is accomplished by maintaining a water curtain 422 between belt 201 and optical sensor 420, as shown in FIG. 4*d*. In some embodiments, shielding is accomplished by maintaining a water purge 424 from a water supply 426 between optical sensor 420 and belt 201, as shown in FIG. 4*e*, or by maintaining a positive air purge (not shown) between the optical sensor and the belt. In some embodiments, as shown in FIG. 4*f*, shielding is accomplished by enclosing optical sensor 420 in a water tank 428 having a transparent cover 430, which then directly contacts the polishing pad (not shown) attached to moving belt 201. These complexities are not required for an inductive proximity sensor.

In a hostile environment, inductive proximity sensors have advantages over contact finger sensors. Airborne slurry and other particulates adhere to the surfaces of contact finger sensors and the polishing belt, thereby changing the calibration of the contact finger sensors. In order to maintain an acceptable degree of calibration, periodic cleaning of the surfaces is necessary. Such periodic cleaning is not required for inductive proximity sensors.

Figure 5:
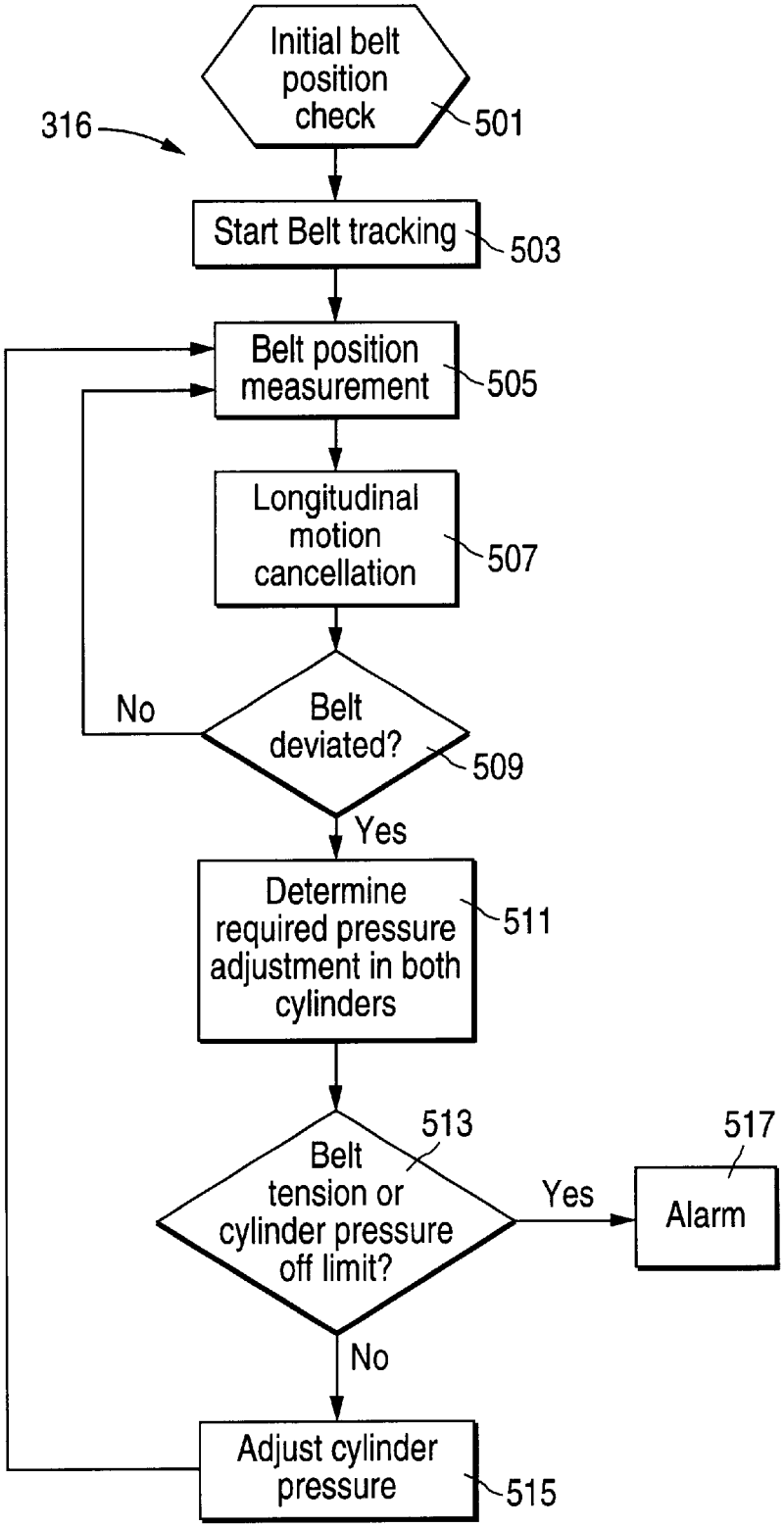
FIG. 5 is a flow diagram detailing the control algorithm of FIG. 3, in accordance with an embodiment of the present invention.

FIG. 5 is a flow diagram detailing a control algorithm used in control mechanism 316, shown schematically in FIG. 3. Control mechanism 316 steers polishing belt 201 within a controlled range, while maintaining adequate belt tension. The tracking system also monitors the trend of the correction signal, which includes a combination of belt tension, cylinder pressure, and lateral displacement signals. A consistent deviation from the equilibrium value observed over several control cycles indicates that the belt/pulley system or the polishing head is unbalanced and warrants inspection or service.

In operation, control mechanism 316 initially checks the belt position against its home position and moves the belt to the home position in block 501. Belt tracking is then activated in block 503. A belt position measurement is then performed in block 505 by reading the signals delivered by inductive proximity sensors 401*a*–401*e* through data acquisition system 314 to processing unit 315. Longitudinal displacement cancellation is performed in block 507 by comparing primary and auxiliary sensor signals, as described above in connection with FIGS. 4*a*–4*c*. A comparison is then performed in block 509 to determine if the lateral belt position has deviated since the previous measurement. If the lateral belt position has not deviated, then the measurement and comparison loop 505–509 is repeated indefinitely. If the lateral belt position has changed, algorithm control is transferred to block 511.

In block 511 a calculation is performed to determine the required pressure adjustment in both cylinders 320, 322, in order to tilt pulleys 302, 304 to steer polishing belt 201. A pressure that is too low can cause the belt to sag. A pressure that is too high can result in belt deformation. In accordance with the present embodiment, the tilt is balanced symmetrically by adding a portion, e.g. half, of the needed tilt correction to one pressure cylinder and subtracting the remaining portion from the opposite pressure cylinder, in order to maintain generally constant average tension on polishing belt 201. This is verified in block 513 by comparing independent measurements of belt tension and cylinder pressure against prescribed limits. If belt tension and cylinder pressure remain within normal limits, then algorithm 316 proceeds to adjust cylinder pressure, in order to correct the measured belt displacement. If either belt tension or cylinder pressure is off limit, then control is returned to block 511 to determine the required pressure adjustments. If the belt tension or cylinder pressure cannot be adjusted to be within limit, then an alarm 517 will alert an operator.

In addition to tracking and correcting lateral displacement of the polishing belt, the above described control system is capable of user-specified lateral displacement of the polishing belt. For example, an arbitrary waveform such as a square wave, sinusoid, sawtooth, or more complex waveform can be superimposed on the desired baseline signal in block 501. Provided that the control loop cycle 505–515 is fast enough, this will cause the polishing belt to undergo user-specified tracking maneuvers such as step, dither, sweep, and/or other lateral displacements.

Figure 1:
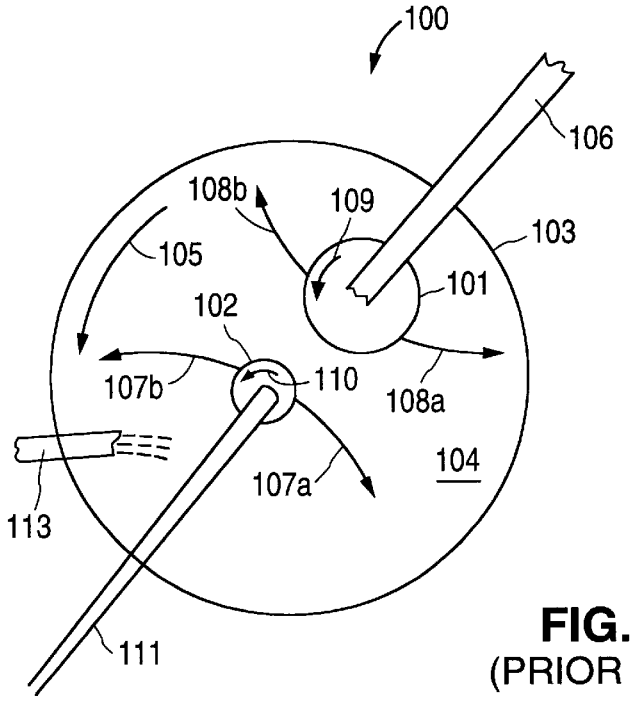
FIG. 1 (PRIOR ART)
FIG. 1 is a schematic plan view of a planetary CMP apparatus.
Figure 2A:
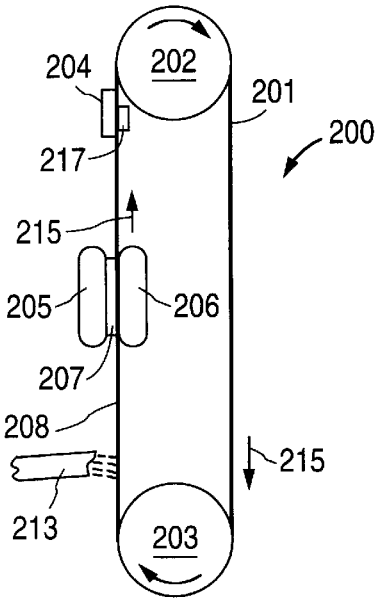
FIGS. 2*a* and 2*b* are side and front views, respectively, of a linear CMP apparatus 200.
Figure 2B:
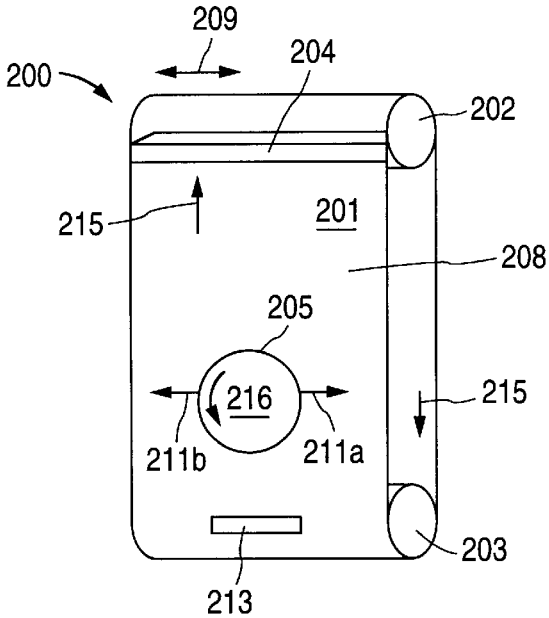

Alternatively, a large cylinder pressure difference between cylinders 320 and 322 is directly applied, to sweep the polishing belt laterally over a range of approximately 1 cm to 5 cm. In some embodiments, belt tension measurement provides a diagnostic signal to confirm that conditioner 204 (see FIGS. 2*a*–2*b*) is engaged and sweeping properly.

Figure 6:
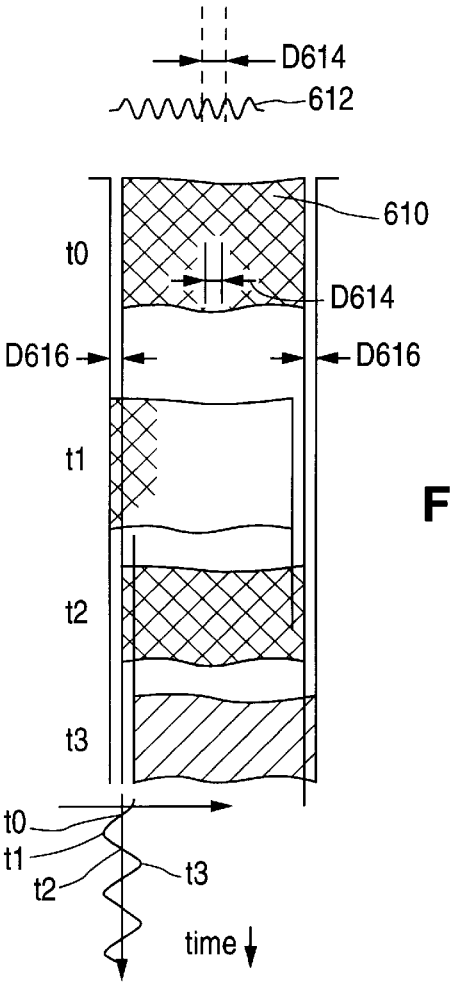
FIG. 6 is a schematic illustration of a user-specified belt displacement in conjunction with a textured polishing pad, in accordance with an embodiment of the present invention.

Polishing pad 208 can have a textured working surface, e.g., a diamond pad 610 as illustrated in FIG. 6. The grooved pattern of diamond pad 610 advantageously provides slurry transport and distribution, as described in Cheng et al., "Polishing Pad Shaping and Patterning," U.S. application Ser. No. [Attorney Docket M-5674 US], co-filed herewith and assigned to Aplex Inc., also the Assignee of the present application. However, to preserve polishing uniformity, it is important that the pattern of diamond pad 610 uniformly contacts the surface of wafer 207. Otherwise diamond pad 610 can cause uneven polish patterns 612 on the wafer surface, having a lateral periodicity equal to the pitch D614 of diamond pad 610. By laterally dithering polishing belt 201 with an amplitude D616 equal to any integral multiple of one-half of pitch D614, the pattern of diamond pad 610 is time-averaged across the wafer surface. In some variations, a sinusoidal dither is applied. In other variations, alternately directed ramp signals are applied to generate a "sawtooth" quasilinear motion. The latter scheme assures substantially equal dwell time of all pattern areas of diamond pad 610 on all parts of the wafer surface, as shown schematically at times t0, t1, t2, and t3, defined graphically in the lower portion of FIG. 6. This smoothes the grooved pattern from the wafer surface.

As described in Cheng et al., U.S. application Ser. No. cited above, the properties of polishing pad 208 can be systematically varied from location to location across a single polishing pad specimen. This is accomplished, for example, by individually treating selected areas of a monolithic polishing pad, or by fabricating a mosaic polishing pad from individual pad segments with selected properties, or by combinations of these and other methods. Among relevant properties are surface hardness (durometer), overall pad thickness, primary pad thickness and secondary pad thickness (stacked pad), porosity, filler type, underlying belt thickness (e.g. stainless steel), belt contour (e.g. concave/convex), and chemical reactivity.

Figure 7A:
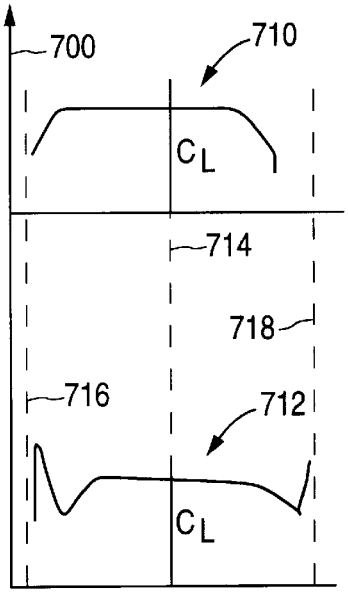
FIGS. 7*a* and 7*b* are schematic illustrations showing examples of mosaic polishing pads, in accordance with an embodiment of the present invention.
Figure 7B:
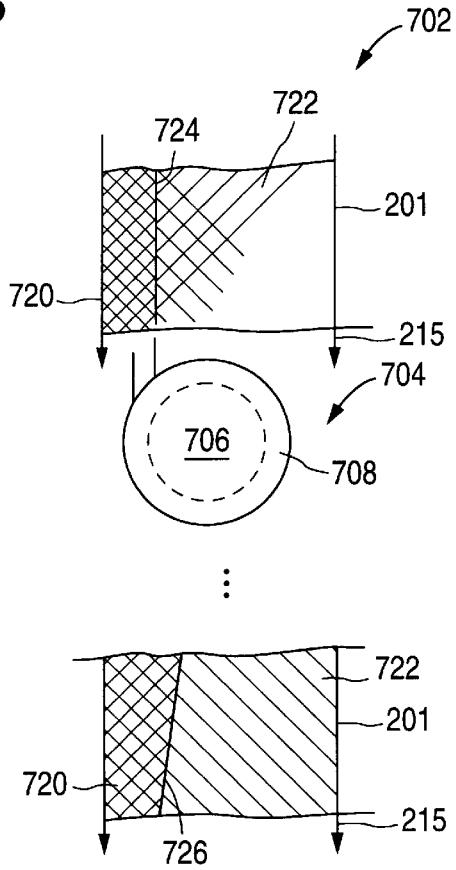

Varying these properties selectively within a single specimen can achieve desirable results. FIGS. 7*a* and 7*b* illustrate schematically an example of a mosaic polishing pad 702. FIG. 7*a* shows removal rate profiles as a function of position along a representative diameter of a wafer surface. Removal rate is shown as a vertical axis 700. The wafer centerline 714 is shown on the horizontal axis. Wafer edges at opposite ends of the representative wafer diameter are shown at positions 716 and 718.

If a particular polishing process results in too slow edge removal on a wafer, as shown graphically in profile 710 of FIG. 7*a*, then a higher removal rate strip of polishing pad 720 is placed along either or both edges of polishing belt 201 to increase wafer edge removal rate. Wafer 704 rotates against the surface of polishing pad 702. The central circular disk 706 of wafer 704 rotates only against slower polishing rate strip 722, whereas the outer edge annulus 708 of wafer 704 spends some dwell time rotating against faster polishing rate strip 720. Therefore outer annulus 708 experiences a faster removal rate relative to inner disk 706 when polishing pad 702 has a faster removal rate strip 720 than when polishing pad 702 has uniform properties. The dwell time of wafer annulus 708 on fast removal strip 720 is controlled by applying a step or ramp function to translate polishing belt 201 laterally to the left or right in FIG. 7*b*.

The seam 724 between adjacent polishing pad strips 720, 722, however, potentially introduces other polishing rate nonuniformities, as described in Cheng et al., U.S. application Ser. No. cited above. To avoid these nonuniformities, polishing belt 201 can be swept or dithered laterally, providing a smooth and gradual transition between adjacent polishing pad strips 720, 722. In some embodiments, two adjacent polishing pad strips 720, 722 having differing removal rates are joined at a slant seam 726 (lower portion of FIG. 7*b*). This configuration provides a gradual effective transition between adjacent polishing pad strips 720 and 722 without sweeping and dithering. However, control over the dwell time and relative removal rates between outer annulus 708 and central disk 706 of wafer 704 is still accomplished by laterally translating polishing belt 201.

Some polishing operations result in a complex removal rate profile, as shown graphically by way of example in profile 712 of FIG. 7*a*. In such a case, an appropriately complex mosaic polishing pad, together with user-specified lateral belt motion, is employed to improve polishing uniformity.

Figure 8:
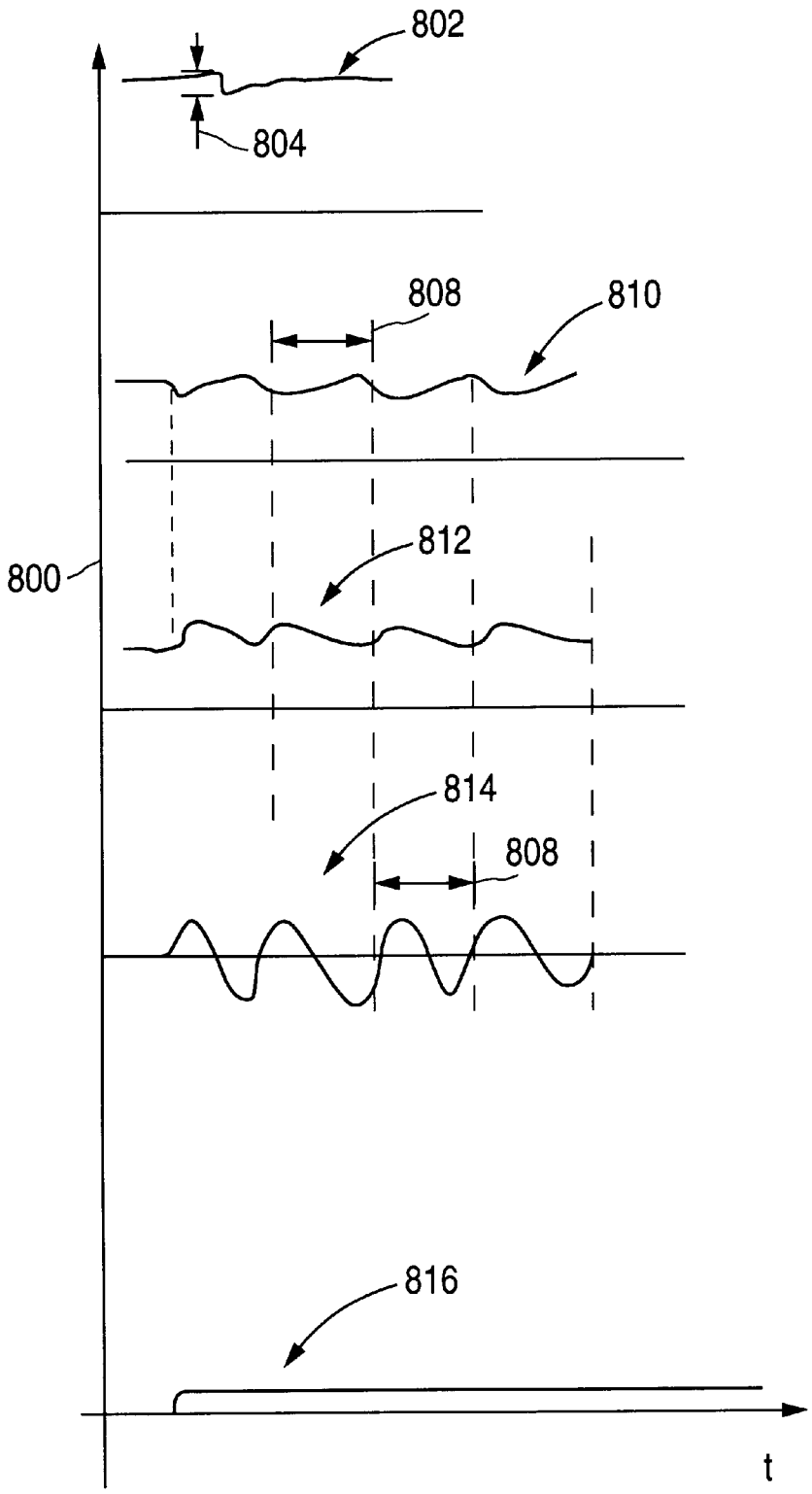
FIG. 8 is a series of graphical representations, showing polishing belt tension measurement as a diagnostic tool to confirm pad conditioner functioning, in accordance with an embodiment of the present invention.

FIG. 8 is a series of graphical representations, showing the use of polishing belt tension measurement as a diagnostic tool to confirm pad conditioner functioning. As conditioner 204 sweeps, it redistributes the loads on the two sides of the belt. A reciprocating sweep pattern produces a modulated tension on the belt. This property can be used for diagnosis of conditioning. Belt tension is measured along vertical axis 800, and time is measured along the horizontal axis. In some embodiments, belt tension measurement provides a diagnostic signal to confirm that conditioner 204 (see FIGS. 2*a*–2*b*) is engaged and sweeping properly. The upper graph 802 in FIG. 8 shows combined left and right side belt tension signal as a function of time. Prior to polishing, conditioner 204 is engaged against polishing pad 208, producing an abrupt change in belt tension. Belt tension signal 802 then undergoes an abrupt change, as illustrated by reference numeral 804, verifying that conditioner 204 is engaged. If a signal change 804 does not occur when conditioner 204 is instructed to engage, then conditioner 204 is not properly engaged.

Similarly, graphs 810 and 812 show the individual belt tension signals at the respective left and right sides of belt 201 coupled to pressure cylinders 320 and 322 respectively (see FIG. 3). If conditioner 204 is sweeping properly, respective belt tension signals 810 and 812 change in a substantially equal but mutually opposite manner with a periodicity 808 characteristic of the sweep. Graph 814 shows the difference between separate side belt tension signals 810 and 812, which is periodically oscillating with approximately twice the amplitude of separate side signal 810 or 812, when conditioner 204 is properly sweeping. Graph 816 shows a flat difference signal between belt tension signals 810 and 812, which results when conditioner 204 fails to sweep.

While embodiments of the present invention have been shown and described, it will be obvious to those skilled in the art that changes and modifications to these illustrative embodiments can be made without departing from the present invention in its broader aspects. Thus it should be evident that there are other embodiments of this invention which, while not expressly described above, are within the scope and spirit of the present invention. Therefore, it will be understood that the appended claims necessarily encompass all such changes and modifications as fall within the described invention's true scope and spirit; and further that this scope and spirit is not limited merely to the illustrative embodiments presented to demonstrate that scope and spirit.

We claim:

1. A method of automated tracking and control of the position of a moving continuous belt, comprising:

measuring the lateral displacement of at least one edge of said belt using at least one non-contact position sensor, said lateral displacement being substantially perpendicular to the direction of travel of said belt and substantially perpendicular to the thickness of said belt, said belt traveling in rolling contact with at least two substantially cylindrical pulleys, each said pulley rotating about a respective pulley axis having a first end adjacent a first edge and a second end adjacent a second edge of said belt;

coupling a measurement output signal from said at least one non-contact position sensor into a processing unit;

applying a control algorithm from said processing unit to a tension adjustment mechanism; and applying differing pressures from said tension adjustment mechanism to said first ends relative to said second ends of said pulley axes, thereby controlling said lateral displacement of said belt.

2. The method of claim 1, wherein said at least one non-contact position sensor is an inductive proximity sensor.

3. The method of claim 2, wherein said at least one non-contact position sensor comprises a first inductive proximity sensor and a second inductive proximity sensor and wherein applying a control algorithm comprises combining an output signal from said first inductive proximity sensor and an output signal from said second inductive proximity sensor to cancel the effects of belt displacement in a direction parallel to said thickness of said belt.

4. The method of claim 3, wherein combining an output signal from said first inductive proximity sensor and an output signal from said second inductive proximity sensor is substantially summing and averaging the output signals of said first and said second inductive proximity sensors.

5. The method of claim 4 wherein said first and second inductive proximity sensors respectively face opposite surfaces of said belt.

6. The method of claim 3, wherein combining an output signal from said first inductive proximity sensor and an output signal from said second inductive proximity sensor is substantially subtracting the output signal of said first inductive proximity sensor from the output signal of said second inductive proximity sensor.

7. The method of claim 6 wherein said first and second inductive proximity sensors face the same surface of said belt.

8. The method of claim 1, wherein measuring the lateral displacement of at least one edge of said belt using said at least one non-contact position sensor is measuring the lateral displacement of at least one edge of said belt using an optical sensor.

9. The method of claim 1, further comprising:

measuring the belt tension adjacent to each edge of said belt independently and delivering a tension output signal;

measuring the applied pressure at said first and second end of said pulley axes independently and delivering a pressure output signal; and applying said tension output signal and said pressure output signal to said control algorithm.

10. The method of claim 9, further comprising attaching said belt to a polishing pad configured for linear polishing.

11. The method of claim 10, further comprising providing, by said tension output signal, verification of engagement and proper functioning of a pad conditioning mechanism.

12. The method of claim 1, further comprising controlling said lateral displacement of said belt by providing user-specified instructions to said control algorithm.

13. The method of claim 12, further comprising causing, by user-specified instructions, said belt to undergo at least one lateral displacement maneuver selected from the group consisting of dither, sawtooth oscillation, step, ramp, and sweep.

* * * * *